US005230815A

United States Patent [19]

Rountree

[11] Patent Number: 5,230,815

[45] **Date of Patent: * Jul. 27, 1993**

[54] PROCESS FOR COATING MACHINE PARTS AND COATED MACHINE PARTS PRODUCED THEREBY

[76] Inventor: Philip L. Rountree, 1140 Lake Vue Dr., Rome, Ohio 44085

[ * ] Notice: The portion of the term of this patent subsequent to Aug. 25, 2009 has been disclaimed.

[21] Appl. No.: 893,839

[22] Filed: Jun. 4, 1992

Related U.S. Application Data

[63] Continuation-in-part of Ser. No. 498,780, Mar. 26, 1990, Pat. No. 5,141,656.

[51] Int. Cl.[5] ..... C10M 103/06

[52] U.S. Cl. ..... 252/25; 252/58; 427/290

[58] Field of Search ..... 252/25, 58; 427/290

[56] References Cited

U.S. PATENT DOCUMENTS 1,658,173 2/1928 Perks .
3,715,790 2/1978 Reinberger .
3,728,776 4/1973 Defazio .
3,992,303 11/1976 Barker et al. ..... 252/58
4,091,518 5/1978 Rutherford .
4,096,076 6/1978 Spiegelberg ..... 252/28
4,238,575 12/1980 Kleiner et al. .
4,292,723 10/1981 Rauscher .
4,724,819 2/1988 Fleri .
5,141,656 8/1992 Rountree ..... 252/58

OTHER PUBLICATIONS

Modern Plastics Encyclopedia, 1984–1985, pp. 14, 22–26, 30, 32, 36, 38 and 75–78.
DOD-P-16232F.

*Primary Examiner*—Jacqueline V. Howard
*Attorney, Agent, or Firm*—Rothwell, Figg, Ernst & Kurz

[57] ABSTRACT

A process for coating a machine part surface wherein the surface is cleaned, abraded and treated so as to render the surface directly bondable to a resin-bonded lubricant coating. A powder coating containing resin and resin-bondable lubricant then is directly applied to the treated machine part surface and cured so as to cross-link the resin.

28 Claims, 1 Drawing Sheet

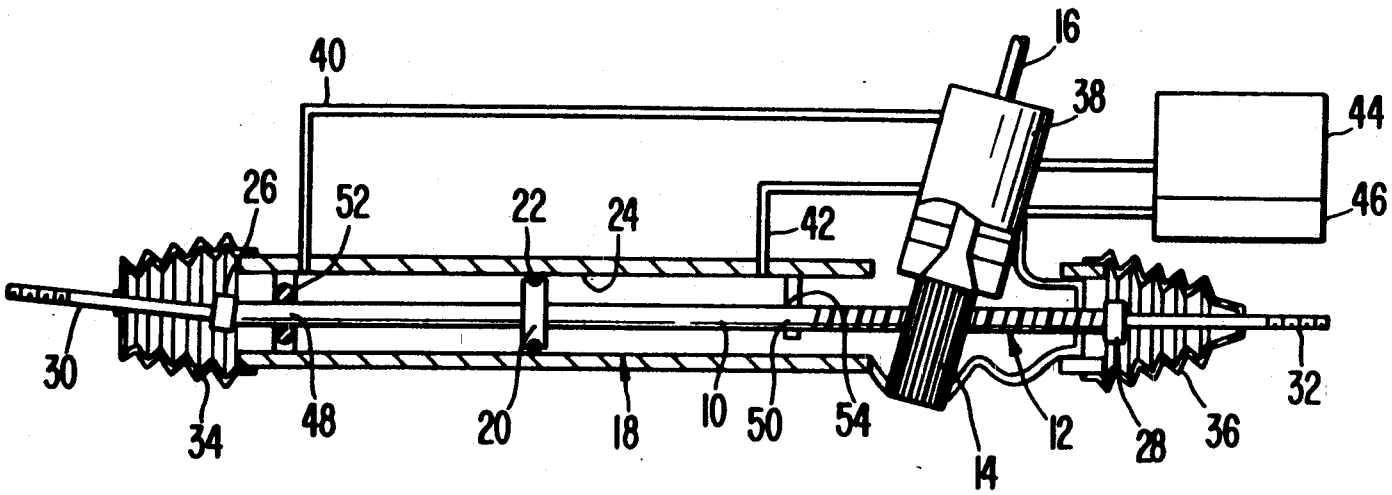
44
46
16
38
40
42
24
22
52
26
32
36
28
12
14
54
50
10
18
20
48
34
30

PROCESS FOR COATING MACHINE PARTS AND COATED MACHINE PARTS PRODUCED THEREBY

CROSS-REFERENCE TO RELATED APPLICATION

This application is a continuation-in-part of U.S. application Ser. No. 498,780, filed Mar. 26, 1990, now U.S. Pat. No. 5,141,656.

BACKGROUND OF THE INVENTION

1. Field of the Invention

The present invention relates to the field of reconditioning machine parts, particularly automotive parts.

2. Description of the Background Art

Most automobiles manufactured in the world today utilize rack and pinion steering systems. In recent years, hydraulic power assist has been added to rack and pinion steering systems which utilize a control valve assembly and a hydraulic cylinder thereof attached directly to the rack. With hydraulic power assist, hydraulic pressure is applied to one side or the other of the rack piston proportional to the movement of the steering column so as to move the rack in the desired direction and thereby steer the vehicle.

In rack and pinion steering systems with hydralic power assist, the rack piston is sealed against the hydraulic cylinder with a face seal. The rack shaft, which transmits the force of the piston to the tie rods, serves as a seal face at opposite ends of hydraulic cylinder. All of these seals are subject to wear due to the nature of the finish of the rack shaft and the cylinder surfaces. When the seals begin to leak, protective boots extending between the tie rods and the ends of the cylinder, which protect the ends of the cylinder from contact with contaminants and debris, begin to fill with hydraulic fluid. Output from the hydraulic pump of the power assist system can thereby be reduced or interrupted and malfunctions may occur.

The natural progression of wear on rack and pinion systems can be accelerated by the introduction of foreign matter in the hydraulic reservoir, or by puncture or failure of one or both of the protective boots, thereby exposing the ends of the hydraulic cylinder. Once this occurs, the progression of malfunction is accelerated when the rack shaft and/or cylinder bore becomes pitted or scored, and leakage becomes a major problem. Similar problems can occur within the pinion housing, causing wear of bearing surfaces therein.

There are various known methods for reconditioning or refurbishing worn machine parts. For example, U.S. Pat. No. 4,724,819 to Fleri discloses a cylinder liner reconditioning process wherein the internal wall of a cylinder liner is cleaned and grit-blasted. A bond coat then is applied to the cylinder wall, followed by steel coating and then coating with Teflon. The thus coated liner then is placed in an oven so as to permanently bond the Teflon thereto.

Other methods for reconditioning machine parts are disclosed in U.S. Pat. Nos. 1,658,173, 3,715,790, 3,728,776, 4,091,518 and 4,292,723, as well as Soviet Patent Publication Nos. 564,136 and 98/00105.

Despite the numerous proposals for reconditioning machine parts known in the art, there remains a need for reconditioning processes for machine parts such as those utilized in rack and pinion steering systems.

SUMMARY OF THE INVENTION

In accordance with the present invention, a process for coating a machine part surface includes the steps of cleaning the machine part surface and abrading the cleaned machine part surface so as to roughen the surface. The roughened surface then is treated so as to render the surface directly bondable to a resin-bonded lubricant coating. A powder coating comprising resin and a resin-bondable lubricant then is directly applied to the thus treated machine part surface. The coating then is cured so as to cross-link the resin.

BRIEF DESCRIPTION OF THE DRAWING

The sole FIGURE is a schematic illustration of a rack and pinion steering system with hydraulic power assist, to which the present invention is applicable.

DESCRIPTION OF THE PREFERRED EMBODIMENTS

The present invention provides a process for coating a machine part surface with a powder containing resin and a resin-bondable lubricant. The coating can be applied to new parts so as to render the new parts more resistant to damage, and can also be utilized to recondition used machine parts.

In preferred embodiments, the powder coating is electrostatically applied to the machine part surface. A powder coating deposited in accordance with the present invention eliminates the need for volatile solvents in the deposition technique. This is particularly advantageous with the increasing restrictions in the use of volatile solvents.

In accordance with one embodiment, the inventive process is applied to working surfaces of a rack and pinion steering system with hydraulic power assist. Such a system is schematically shown in the drawing, and includes a rack shaft 10 having a rack gear 12 which cooperatively interacts with a pinion gear 14 attached to a steering column 16.

The pinion is a worm gear that is mechanically linked to a steering wheel (not shown) by means of the steering column 16. As the steering wheel turns the pinion gear 14, the teeth of the pinion gear mesh with the rack gear 12 to provide steering direction for the vehicle. The steering direction initiated by the pinion and rack gears is transmitted to the front wheels (not shown) of the vehicle through inner socket assemblies 26 and 28 connected to respective tie rods 30 and 32, and finally to steering arms (not shown) connected to the front wheels. Protective boots 34 and 36 in the form of rubber or plastic bellows, surround the inner socket assemblies 26 and 28, respectively, so as to prevent contaminants from entering the internal mechanism and destroying the gear assembly.

For hydraulic power assist, the rack shaft 10 is surrounded by a hydraulic cylinder 18 which contains a hydraulic piston 20 attached directly to the rack shaft 10. Piston 20 includes an o-ring seal 22, forming a fluid-tight interface with the cylinder wall 24.

Hydraulic cylinder 18 is a double-acting cylinder. As hydraulic pressure is applied to either side of piston 20 via respective lines 40 and 42, shaft 10 will move away from the pressurized chamber. Since shaft 10 is a mechanical link to the tie rods and steering, movement of shaft 10 directs the vehicle.

The hydraulic power assist system is controlled by a control valve assembly 38 which is actuated by the turning of steering column 16.

Pressure is applied in the hydraulic power assist system by means of a hydraulic pump 44 in communication with a hydraulic fluid reservoir 46.

Seal surface areas 48 and 50 of rack shaft 10 serve as the seal faces at respective ends 52 and 54 of cylinder 18. The rack shaft 10 typically is made of hardened steel having sufficient surface roughness to provide a lubricated seal in areas 48 and 50 of the rack shaft. If the finish in these areas is too smooth, lubricant starvation occurs and the seals wear prematurely. If the finish in these areas is too rough, the seal leaks at the outset.

By the process of the present invention, the seal areas of the rack are protected against random and incipient failure during normal operation, and the mating seal surfaces are protected against wear, corrosion, pitting and abrasion when foreign matter is introduced into the system. In addition to protecting such mating surfaces, the invention may be used to repair working surfaces which suffer minor damage, and may be used in conjunction with other known techniques to repair severely damaged elements. For example, a machine part such as a rack which has been severely damaged, can be metalized or plated with any of the metals known in the art to be suitable therefor by various well-known techniques, to a size greater than its original size, and ground back precisely to its original dimension prior to subjecting the part to the process of the present invention.

The present invention will be further described with reference to coating of the working surfaces of a steel rack shaft 10, which may either be a new rack shaft, or a used rack shaft to be reconditioned.

The rack shaft 10 is initially cleaned by degreasing the rack in any suitable manner. For example, the rack can be degreased by immersion in a hot caustic soap solution or utilizing a vapor degreaser with a degreasing solvent.

When degreasing by immersion in a hot caustic soap solution, the solution can contain various additives, including surfactants, foaming agents, and the like.

Vapor degreasing can be accomplished in a vented vessel containing a solvent chamber above which is located a vapor condensing chamber in fluid communication with the solvent chamber. The solvent chamber contains a degreasing solvent such as 1:1:1 chloroethane, in which heating elements are immersed. The rack is positioned in the condensing chamber, which is surrounded by a cooled condensing jacket. The solvent is vaporized by the heating elements immersed therein, and condenses on the rack in the condensing chamber so as to bathe the rack in hot, chemically pure solvent. The grease is carried away with the condensed solvent as it drips from the rack and returns to the solvent chamber.

After degreasing, any surfaces which are not to be treated according to the inventive process are suitably masked. One such surface of rack 10 is the seal groove of piston 20, which can be masked by placing an O-ring in the seal groove.

The cleaned and masked rack 10 then is abraded so as to roughen the surface. The rack can be abraded by grit-blasting with an abrasive media such as aluminum oxide, silica sand, silicon carbide, metal shot, and the like. The grit grade may vary from about 20 grit to about 120 grit, depending on the desired surface, with 80 grit being typically used. The rack is grit-blasted using air pressure within the range of from about 40 psi to about 100 psi, depending on the hardness of the steel being treated, with increased air pressure being utilized with harder steels. Grit adhering to the rack is blown off under pressurized air after blasting is completed.

The grit-roughened surface then is treated so as to render the surface directly bondable to a resinbased lubricant coating. When applying the inventive process to a steel rack shaft 10, the grit-roughened surface is treated with a phosphatizing agent, with surface areas not to be treated, such as the O-ring groove of piston 20, being masked. Suitable phosphatizing agents include zinc phosphate and manganese phosphate. Zinc phosphate is preferable for use in applications where corrosion is a problem, whereas manganese phosphate provides better wear characteristics. The coating thickness may also vary depending on the degree of corrosion or abrasion resistance versus the surface roughness desired. The thickness of the phosphate coating may vary from about 0.0002 inch to 0.0010 inch in thickness depending on whether a fine grain phosphate formulation is used or whether a heavy grain phosphate formulation is used. In preferred embodiments, a thickness of about 0.0003 inch is obtained by use of a microcrystalline phosphate formulation.

If a damaged portion is built up by application of stainless steel and then ground down to the original dimension, phosphate treatment is not undertaken.

If a part being processed, such as rack 10, has been heat treated to a Rockwell hardness in excess of about 39, resulting hydrogen embrittlement must be relieved. This can be accomplished by baking the rack in an oven at about 350° F. for about 4 hours, or the hydrogen can be allowed to dissipate from the rack to reduce the brittleness thereof by normal attrition at room temperature for about 120 hours.

After phosphatizing or otherwise pre-treating the part and any necessary hydrogen dissipation, a powder coating comprising a resin and resin-bondable lubricant is applied to the working surfaces to a thickness of from about 0.0005 inch to about 0.004 inch, with a preferred thickness of about 0.001 inch. As noted above, in preferred embodiments, the powder coating is electrostatically applied to the working surfaces.

In preferred embodiments, the resin is a thermosetting resin capable of withstanding the working temperatures of the part and having good adhesive qualities, low friction, excellent strength, wear resistance, chemical resistance, ductility, stress crack resistance, flex strength, low absorption and good application properties. Known resins include phenolics, epoxies, polyimides, polyamide-imides, polyesters, acrylics, polyphenylene sulfides, polybutylenes, furans, polyolefins such as polyethylenes, polypropylenes etc., polymethylpentenes, and the like. In preferred embodiments, the resin is a thermosetting phenolic resin powder most preferably having a particle size of about 3 to about 20 microns.

In accordance with the present invention, a lubricant powder is mixed with the resin powder. The lubricant and resin powders can be mixed by any suitable means, such as by a tumbling mixer.

If more uniform mixing of the resin and lubricant is desired, the resin can be dissolved in a solvent and the lubricant then added with stirring. The mixture then can be dried, pelletized and ground to the desired particle size.

Known lubricants include fluoropolymers such as polytetrafluoroethylene (Teflon®), fluorinated ethylene-propylene copolymer, perfluoroalkoxy resin, ethylene-tetrafluoroethylen copolymer, polyvinylidene fluoride, polychlorotrifluoroethylene, ethylenechlorotrifluoroethylene copolymer and polyvinyl fluoride, as well as molybdenum disulfide, tungsten disulfide, and titanium disulfide. In preferred embodiments, the lubricant is molybdenum disulfide, tungsten disulfide or titanium disulfide, most preferably molybdenum disulfide having a particle size of less than about 1 micron.

The ratio of by weight of lubricant powder to resin powder in the mixture ranges from about 1:20 to about 1:3, depending upon the properties desired, i.e., corrosion resistance vs. friction and wear. When coating rack shafts, the ratio by weight of lubricant powder to resin powder in preferred embodiments is about 1:9.

After application of the mixture of lubricant powder and resin powder to the working surfaces of the machine part, the coating is cured so as to cross-link the resin. Typically, the coating is cured at a temperature within the range of from about 250° F. to about 700° F. for from about 5 minutes to about 2 hours according to a schedule which is determined by the type of resin used and the amount of catalyst present. A typical schedule is as follows:

| Curing Time (min.) | Part Temperature °F. |
|---|---|
| 15 | 700 |
| 20 | 600 |
| 25 | 450 |
| 30 | 350 |
| 60 | 250 |

For coating rack shafts with a 1:9 formulation of molybdenum disulfide powder and phenolic resin powder, a curing time of from about 30 minutes to about 1 hour at about 350° F. is preferred.

For aluminum machine part surfaces, the process is modified in the preparation of the substrate. The aluminum surface is cleaned in a non-silicated neutral cleaning solution such as ALUMA-K by Kleen-Corps Inc., or vapor degreased as described above. The part then is dried and grit-blasted at pressures toward the lower end of the pressure range set forth above with silica sand or aluminum oxide so as to roughen the surface. The roughened surface then is hardened by anodizing the surface or by chemical conversion such as chromate conversion. Alternatively, the roughened surface is hard coated to provide a suitable base for applying the powder coating. The powder coating then is electrostatically applied to the surface as described above, and cured.

If desired, metal or ceramic particles can be codeposited with the mixture of resin and lubricant powders. After curing, the coating can be ground to the original dimensions.

As noted above, the powder coating process of the invention eliminates the need for volatile solvents in the deposition technique, an important advantage with increasing restrictions in the use of volatile solvents. A resin-bonded lubricant coating deposited in accordance with the present invention exhibits characteristics equal to or superior to those obtained by conventional deposition techniques using liquid carriers. Coatings deposited according to the invention have exhibited comparable friction characteristics to solvent-deposited coatings, but with substantially increased wear life.

By coating machine part surfaces in accordance with the present invention, discontinuities of the surface are filled and the coating burnishes in a short period of time to a smooth, frictionless surface providing non-leaking seals. Furthermore, such seals wear at a rate considerably less than when utilizing conventional steel working surfaces. The coating process of the present invention protects seals against random and incipient failure during normal operation, and protects mating surfaces against wear, corrosion, pitting and abrasion when foreign matter is introduced into the system.

Since many modifications, variations and changes in detail may be made to the described embodiments, it is intended that all matter in the foregoing description and shown in the accompanying drawing be interpreted as illustrative and not in a limiting sense.

What is claimed is:

1. A process for coating a machine part surface comprising cleaning the machine part surface, abrading the cleaned machine part surface so as to roughen the surface, treating the roughened surface so as to render the roughened surface directly bondable to a resin-bonded lubricant coating, then applying a powder coating directly to the roughened machine part surface, the powder coating comprising a resin and a resin-bondable lubricant, and curing the coating so as to cross-link the resin.

2. The process of claim 1 wherein said coating is electrostatically applied to said roughened machine part surface.

3. The process of claim 2 wherein the machine part surface is steel, and wherein the treating step comprises treating the roughened surface with a phosphatizing agent so as to render the surface directly bondable to the powder coating.

4. The process of claim 3 wherein the phosphatizing agent is selected from the group consisting of zinc phosphate and manganese phosphate.

5. The process of claim 3 wherein, after treatment with said phosphatizing agent, hydrogen is dissipated from the machine part so as to reduce brittleness thereof prior to application of the powder.

6. The process of claim 2 wherein the machine part surface is aluminum, and wherein said roughened surface is hardened prior to application of the powder coating thereto.

7. The process of claim 6 wherein said roughened surface is anodized or chemically converted to harden said roughened surface prior to application of the powder coating thereto.

8. The process of claim 2 wherein said cleaning comprises degreasing said machine part surface.

9. The process of claim 8 wherein said surface is degreased by immersion in a degreasing solution.

10. The process of claim 9 wherein said degreasing solution is a hot caustic soap solution.

11. The process of claim 8 wherein said machine part surface is degreased in a vapor degreaser with a degreasing solvent.

12. The process of claim 2 wherein said cleaned machine part surface is abraded by grit-blasting.

13. The process of claim 12 wherein said grit-blasting is with an abrasive media having a grade within the range of from about 20 grit to about 120 grit using air pressure within the range of from about 40 psi to about 100 psi.

14. The process of claim 13 wherein after grit-blasting, abrasive media is blown off the surface prior to application of said powder.

15. The process of claim 2 wherein said powder is applied to said surface so as to form a coating having a thickness of from about 0.0005 to about 0.004 inch.

16. The process of claim 15 wherein said powder is applied to said surface so as to form a coating having a thickness of about 0.001 inch.

17. The process of claim 2 wherein said lubricant is molybdenum disulfide.

18. The process of claim 2 wherein the powder contains said lubricant powder and said resin powder at a respective ratio by weight within the range of from about 1:20 to about 1:3.

19. The process of claim 18 wherein said resin is a thermosetting phenolic resin powder.

20. The process of claim 19 wherein said lubricant is molybdenum disulfide.

21. The process of claim 20 wherein said ratio is about 1:9.

22. The process of claim 21 wherein said coating is cured for from about 30 minutes to about 1 hour at a temperature of about 350° F.

23. The process of claim 20 wherein the resin has a particle size of from about 3 microns to about 20 microns, and the lubricant has a particle size of less than about one micron.

24. The process of claim 2 wherein said coating is cured at a temperature within the range of from about 250° F. to about 700° F.

25. The process of claim 6 wherein said surface is cleaned with a non-silicated neutral cleaning solution.

26. A process for coating a working surface of a steel rack shaft for a rack and pinion steering system, comprising cleaning the working surface, abrading the cleaned surface so as to roughen the surface, phosphatizing the roughened surface so as to render the surface directly bondable to a resin-bonded lubricant coating, electrostatically applying a powder coating directly to the phosphatized surface, the powder comprising a resin and a resin-bondable lubricant, and curing the coating so as to cross-link the resin.

27. A process for coating an aluminum working surface of a rack shaft for a rack and pinion steering system, comprising cleaning the aluminum rack shaft surface, abrading the cleaned rack shaft surface so as to roughen the rack shaft surface, hard-coating the roughened rack shaft surface so as to render the rack shaft surface directly bondable to a resin-bonded lubricant coating, electrostatically applying a powder coating directly to the hard-coated rack shaft surface, the powder comprising a resin and a resin-bondable lubricant, and curing the coating so as to cross-link the resin.

28. A machine part having a working surface comprising a machine part surface on which has been deposited a powder coating comprising resin and resin-bondable lubricant, said powder coating being cured so that said machine part surface is directly bonded to the cured, resin-bonded lubricant coating, which coating forms an outer layer of said machine part.

* * * * *